United States Patent [19]

Puff

[11] Patent Number: 4,531,841

[45] Date of Patent: Jul. 30, 1985

[54] ELECTRONIC AUDIO-VISUAL TIMEPIECE

[76] Inventor: Norbert M. Puff, 427 Catalina Dr., Newport Beach, Calif. 92663

[21] Appl. No.: 626,544

[22] Filed: Jun. 29, 1984

Related U.S. Application Data

[63] Continuation-in-part of Ser. No. 446,642, Jul. 30, 1982, Pat. No. 4,466,743.

[51] Int. Cl.[3] ..... G04B 21/08; G04C 19/00

[52] U.S. Cl. ..... 368/63; 368/82; 368/228

[58] Field of Search ..... 368/10, 62, 63, 76, 368/80, 82, 84, 223–224, 228, 239, 242

[56] References Cited

U.S. PATENT DOCUMENTS

| | | | |
|---|---|---|---|
| 3,835,040 | 9/1974 | Hughes, Jr. | 368/63 |
| 4,312,057 | 1/1982 | Kume | 368/63 |
| 4,389,121 | 6/1983 | Hashimoto et al. | 368/63 |
| 4,421,420 | 12/1983 | Ushikoshi | 368/80 |

*Primary Examiner*—Vit W. Miska

[57] ABSTRACT

An electronic audio-visual timepiece which includes a time updating apparatus for producing updated time information in order to generate an updated time output signal and a processor for processing the updated time output signal in order to generate an audio drive input signal and a visual drive input signal. The electronic audio-visual timepiece also includes a speech synthesizer and a visual display. The speech synthesizer includes a work select network for selecting words forming a sentence telling time which the synthetically produced voice of the character's voice uses to audibly tell the time in response to the audio drive input signal. The visual display includes a stacked array of a plurality of alternating transparent and liquid crystal members with a set of different body position of the character and a liquid crystal driving circuit which selectively and repetitively drives each of the plurality of liquid crystal members to provide animated movement of the character's body in order to visually indicate the time.

7 Claims, 3 Drawing Figures

ELECTRONIC AUDIO-VISUAL TIMEPIECE

This is a continuation-in-part of the application, Ser. No. 446,642, filed July 30, 1982, now U.S. Pat. No. 4,466,743.

BACKGROUND OF THE INVENTION

1. Field of the Invention

The present invention relates to an audio-visual timepiece and more particularly to an electronic audio-visual timepiece which uses the synthetically-produced voice of a character to audibly tell the time and which has an animated display of the character showing his body's movement in order to visually indicate the time with his body's movement being in sychronization with his voice.

2. Description of the Prior Art

U.S. Pat. No. D82,245, entitled Watch Dial, issued to Irving Breger on Oct. 14, 1930, teaches an ornamental design for a dial of a watch in the arms of a cartoon figure function as the hands of the watch.

U.S. Pat. No. 3,747,330, entitled Animated Time Piece, issued to Henry Tupone on July 24, 1973, teaches a time piece which has animated motion resulting from an annular member which is mounted slidably around an eccentrically mounted, rotatable wheel. A time mechanism rotates a shaft on which the wheel is eccentrically mounted at the rate of one rotation per minute. The time piece also has a rotatable disc which is concentrically mounted on the shaft and which has an animated appearing object disposed thereon.

U.S. Pat. No. 3,461,665, entitled Animated Novelty Clock, issued to Edward F. Cielaszyk on Aug. 19, 1969, teaches a spring wound novelty clock which has a decorative design and which is equipped with a characterized object which is animated for a predetermined period immediately following each time the clock is wound.

U.S. Pat. No. 3,796,043, entitled Continuous Wipe-Out Clocks, issued to Ronald William Ebdon on Mar. 12, 1974, teaches a timing device which provides a pictorial representation of the passage of time.

U.S. Pat. No. 4,310,909, entitled Analog Electronic Time Piece, issued to Masanori Fujita on Jan. 12, 1982, teaches an analog time which has a plurality of optical displaying elements in the form of pointers which are radially disposed. The pointers are displayed optically in response to a clocking output. The short pointer is displayed separately by lighting up either one of the short displaying segment adjacent to the lighted long pointer displaying segment in order to prevent the longer pointer from being displayed alone when the displaying segments for the long and short pointers to be lighted up coincide thereby enabling the long and short pointers to be easily distinguished.

U.S. Pat. No. 3,998,045, entitled Talking Solid State Timepiece, issued to Robert W. Lester on Dec. 21, 1976, teaches a talking timepiece which will have all the same characteristic of a normal wrist watch, but with the read-out a spoken tone, which will actually give the time to the nearest minute, in a voice composed from sufficient information bits to be a reasonably faithful reproduction of either the owner's voice or the voice of a person of his selection. The voice may be recorded in any language with or without other extraneous information.

U.S. Pat. No. 4,287,584, entitled Speech Synthesizer Timepiece, issued to Akira Tanimoto and Kashihara Mituhiro on Sept. 1, 1981, teaches a speech synthesizer timepiece which provides audible sounds indicative of time and/or calendar information. The audible sounds are followed by an adjective phase which represents such a unit of the preceding time and/or calendar information as month, day, day of the week, hours and minutes.

U.S. Pat. No. 4,279,030, entitled Speech Synthesizer Timepiece, issued to Sigeaki Masuzawa on July 14, 1981, teaches a speech synthesizer timepiece which produces audible sounds indicative of updated time information.

U.S. Pat. No. 4,280,209, entitled Electronic Alarm Clock, issued to Jac A. Mooney on July 21, 1981, teaches an electronic alarm clock which includes a microprocessor for comparing the existing time expressed as digital data with the stored digital value.

U.S. Pat. No. 3,870,818, entitled Solid State Digital Automatic Voice Response System, issued to William A. Barton and John E. Stork on Mar. 11, 1975, teaches a signalling system for providing an automatic voice announcement of a condition being monitored.

U.S. Pat. No. 4,266,096, entitled Audible Output Device for Talking Timepieces, Talking Calculators and the Like, issued to Tomohiro Inoue and Sigeaki Masuzawa on May 5, 1981, teaches an audio output device which is useful in timepieces or calculators and which features a prestored and preselected order of digital codes representing speech words and pauses. These digital codes are outputted through gate circuitry responsive to pause codes.

U.S. Pat. No. 4,294,516, entitled Moving Picture Apparatus, issued to Philip A. Brooks on Oct. 31, 1981, teaches an apparatus for creating the effect upon a viewer of a three-dimensional moving image which includes a stacked array of a plurality of alternating transparent and liquid crystal members.

U.S. Pat. No. 4,312,057, entitled Electronic Timepiece Providing Audible and Visible Time Indications, issued to Kazunari Kume on Jan. 19, 1982, teaches an audio-visual electronic timepiece which includes an oscillator circuit, a frequency divider which is electrically coupled to the oscillator circuit, a minutes-counter which is electrically coupled to the frequency divider, an hours-counter which is electrically coupled to the minutes-counter, a decoder which is electrically coupled to the minutes-counter and the hours-counter, and a display which is electrically coupled to the decoder. The audio-visual electronic timepiece also includes an identification circuit which is electrically coupled to the minutes-counter and the hours-counter, an information signal generation circuit which is electrically coupled to the frequency divider, a control circuit which is electrically coupled to the identification circuit and the information signal generation circuit, a switch circuit which is electrically coupled to the control circuit and a sound-producing element which is electrically coupled to the information signal generation circuit. U.S. Pat. No. 4,205,517, entitled Alarm Electronic Timepiece, issued to Fumikazu Murakami and Takuro Fukuichi on June 3, 1980, teaches an alarm electronic timepiece which includes a seconds-counter and days-counter.

U.S. Pat. No. 3,665,700, entitled Watch with Ornamental Running Indicator, issued to James S. Ditello on May 30, 1972, teaches a wrist watch which includes a case having a radial casing extension which houses a pendulum visible concurrently with and adjacent to the face of the watch. The pendulum is connected to an extension of the pallet arbor of the watch to be oscillated during the operation of the watch so that the pendulum provides a moving indication that the watch is operating and also provides an ornamental effect.

U.S. Pat. No. 4,355,381, entitled Electronic Timepiece with Electro-Optic Display, issued to Masanori Fujita on Oct. 19, 1982, teaches an electronic timepiece which includes an optical display having a number of separate display elements in the shape of time-indicating hands, a clock pulse generator which generates clock pulses, time counter which counts the clock pulses and generates time data and a selector which receives the time data and provides selected outputs of time units which are representative of time.

U.S. Pat. No. 4,309,701, entitled LSI Device Including a Liquid Crystal Display Drive, issued to Toshio Nishimura on Jan. 5, 1982, teaches a circuit for driving a liquid crystal display device.

U.S. Pat. No. 4,308,534, entitled Multiplexing Liquid Crystal Display Device having Different Display Formats, issued to Tomoo Yamamoto on Dec. 29, 1981, teaches a multiplexing liquid crystal display device for displaying a figure.

U.S. Pat. No. 4,338,600, entitled Liquid Crystal Display System Having Temperature Compensation, issued to Jeraldo G. Leach on July 6, 1982, teaches a data processing system for a liquid crystal display.

U.S. Pat. No. 4,289,383, entitled Light Dot Matrix Display, issued to Jack Schwarzschild on Sept. 15, 1982, teaches an electro-optic display of the type operable to provide an image viewable either in the transmissive or reflective modes.

SUMMARY OF THE INVENTION

In view of the foregoing factors and conditions which are characteristic of the prior art it is the primary object of the present invention to provide an electronic audio-visual timepiece which uses the synthetically-produced voice of a character to audibly tell the time and which has an animated display of the character showing his body's movements in order to visually indicate the time with his body's movements being in sychronization with his voice.

It is another object of the present invention to provide an electronicly audio-visual timepiece which uses an electronicly programable read only memory to select and create a synthetically-produced voice for a character to audibly tell the time.

It is still another object of the present invention to provide an electronic audio-visual timepiece which uses an electronicly programmable read only memory to select and create an animated display of the character showing his body's movements in order to visually indicate the time with his body's movements.

In accordance with the present invention an embodiment of an electronic audio-visual timepiece which includes a time updating apparatus for producing updated time information in order to generate an updated time output signal and a processor for processing the updated time output signal in order to generate an audio drive input signal and a visual drive input signal is desribed. The electronic audio-visual timepiece also includes a speech synthesizer and a visual display. The speech synthesizer includes a word select network for selecting words forming a sentence telling time which the synthetically produced voice of the character's voice uses to audibly tell the time in response to the audio drive input signal, a read only memory for generating a plurality of digital input signals representing the sentence telling time, an digital to analog converter for converting the plurality of digital input signals to a plurality of analog input signals, a shape filter for shaping and filtering the plurality of analog input signals, an amplifier for amplifying the plurality of shaped and filtered analog input signal and a miniature speaker. The visual display includes a stacked array of a plurality of alternating transparent and liquid crystal members with a set of different body position of the character and a liquid crystal driving circuit which selectively and repetitively drives each of the plurality of liquid crystal members to provide animated movement of the character's body in order to visually indicate the time.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
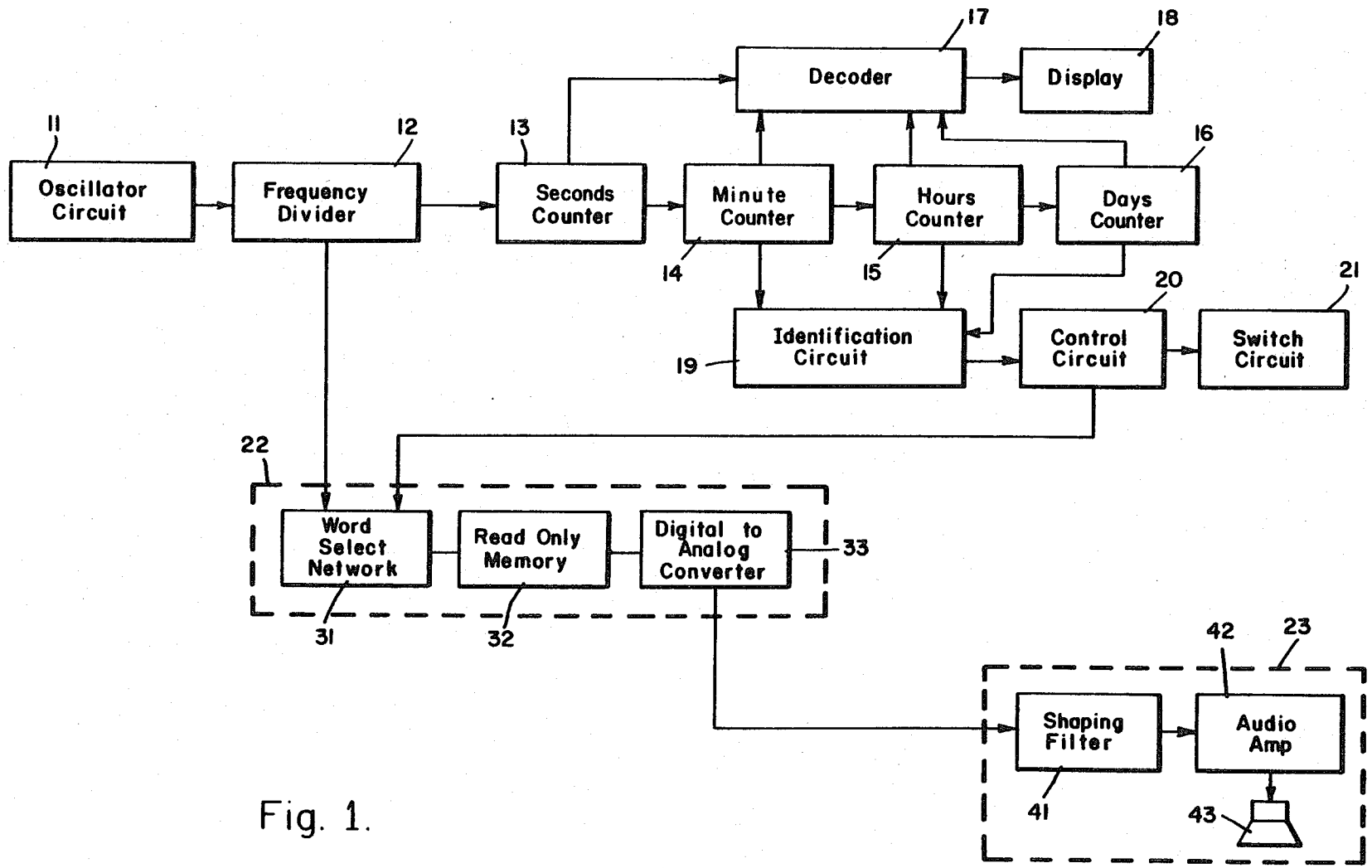
FIG. 1 is a schematic drawing of an electronic audio-visual timepiece using a synthetically produced voice of a character to audibly tell the time and having an animated display of the character in which his body movements visually indicate the time with his body's movements being in sychronization with his voice which has been constructed in accordance with the principles of the present invention.

In order to best understand the present invention it is necessary to refer to the following description of its preferred embodiment in conjunction with the accompanying drawing. Referring to FIG. 1 an electronic audio-visual timepiece 10 includes an oscillator circuit 11, a frequency divider 12 which is electrically coupled to the oscillator circuit 11, a seconds-counter 13 which is electrically coupled to the frequency divider 12, a minutes-counter 14 which is electrically coupled to the seconds-counter 13, an hours-counter 15 which is electrically coupled to the minutes-counter 14, a days-counter 16 which is electrically coupled to the hours-counter 15, a decoder 17 which is electrically coupled to the seconds-counter 13, the minutes-counter 14, the hours-counter 15, and the days-counter 16, and a display 18 which is electrically coupled to the decoder 17. The electronic audio-visual electronic timepiece 10 also includes an identification circuit 19 which is electrically coupled to the seconds-counters 13, the minutes-counter 14, the hours-counter 15 and the days-counter 16, a control circuit 20 which is electrically coupled to the identification circuit 19 and the information signal generation circuit 20 and a switch circuit 21 which is electrically coupled to the control circuit 20. The electronic audio-visual electronic timepiece 10 further includes an information signal generation circuit 22, which is electrically coupled to the frequency divider 12 and the control circuit 20, and a sound-producing system 23, which is electrically coupled to the information signal generation circuit 22, which form a speech synthesizer. U.S. Pat. No. 4,312,057 and U.S. Pat. No. 4,205,517 teach similar combined speech synthesizers and electronic timepieces.

Figure 2:
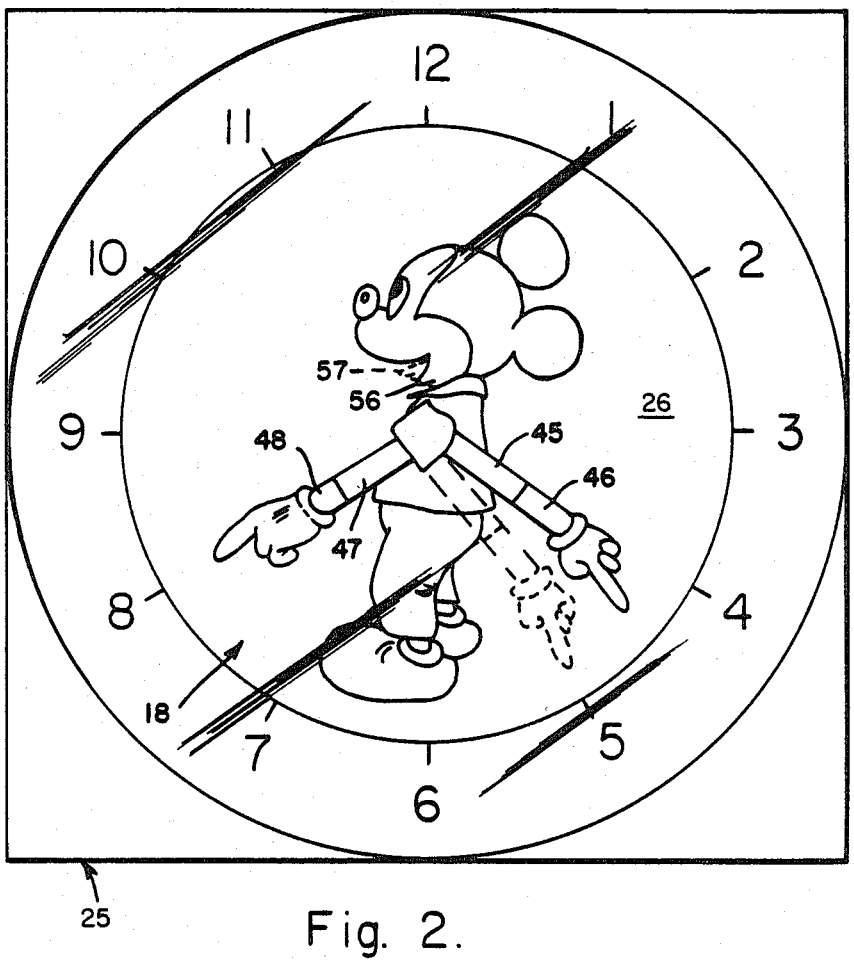
FIG. 2 is a front plan view of the electronic audio-visual timepiece of FIG. 1.

Referring to FIG. 2 in conjunction with FIG. 1 the electronic audio-visual timepiece 10 incorporates the synthetically produced voice of a character for audibly telling the time with an animated display of the character so that the character's body movements also visually indicate the time and may be in sychronization with the character's voice. The electronic audio-visual timepiece 10 also includes a housing 25 having a face plate 26. The time updating system is disposed in the housing 25 and produces updated time information and generates an updated time output signal. The decoder 17 which may be a microprocessor processes the updated time output signal and generates an audio drive input signal and a visual drive input signal. The speech synthesizer generates the synthetically produced voice of the character in a predetermined speech pattern in order to audibly tell the time in response to the audio drive input signal and the display 18 visually displays the character's body movements in order to visually indicate the time in response to the visual drive input signal. The character's body movements may be in sychronization with the character's voice, such as the voice of Mickey Mouse.

Referring again to FIG. 1 which is the information signal generation circuit 22 includes a word select network 31 which is electrically coupled to the frequency divider 12 and the control circuit 20 and which selects words in order form a sentence telling time which the synthetically produced voice of the character's voice uses to audibly tell the time in response to the audio drive input signal, a read only memory 32 which is electrically coupled to the word select network 31 and which generates a plurality of digital input signals representing the sentence telling time, and an digital to analog converter 33 which is electrically coupled to the read only memory 32 and which converts the plurality of digital input signals to a plurality of analog input signals. The sound-producing system 23 includes a shaping filter 41 which is electrically coupled to the digital to analog converter 33 and which shapes and filters the plurality of analog input signals, an audio amplifier 42 which is electrically coupled to the shaping filter 41 and which amplifies the plurality of shaped and filtered analog input signal and a speaker 43 which is electrically coupled to the audio amplifier 42. The read only memory 32 may be electronicly programmable and the word select network 31 may further include a processing circuit which generates a sentence telling time which is electrically coupled to the electronicly programmable read only memory 32 on which data providing the words and speech patterns of a character's voice is stored. U.S. Pat. No. 4,266,096 teaches an audio output device which is useful in timepieces and which features a prestored and preselected order of digital codes representing speech words and pauses.

Figure 3:
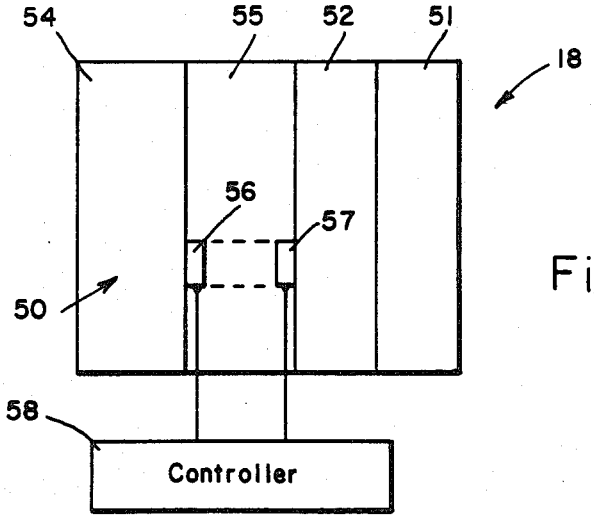
FIG. 3 is a schematic drawing of the animated display of the electronic audio-visual timepiece of FIG. 1.

Referring to FIG. 3 in conjunction with FIG. 1 and FIG. 2 the display 18 of the electronic audio-visual timepiece 10 includes a drawing of the body of Mickey Mouse without his hands and arms, a plurality of first minute light segments 45 and second minute light segments 46 and a plurality of first hour light segments 47 and second hour light segments 48. The first minute light segments 45 and the first hour light segments 47 are in the shape of the arms of Mickey Mouse. The second minute light segments 46 and the second hour light segments 48, which are shorter than the second minute light segments 46, are in the shape of the forearms and hands of Mickey Mouse. U.S. Pat. No. 4,310,909 teaches a similar electronic timepiece which has a plurality of optical displaying elements in the form of pointers which are radially disposed. U.S. Pat. No. 4,355,381 also teaches a similar electronic timepiece which includes an optical display having a number of separate display elements in the shape of time-indicating hands.

Still referring to FIG. 3 in conjunction with FIG. 1 and FIG. 2 the display 18 of the electronic audio-visual timepiece 10 also includes a visual display apparatus 50 having a stacked array of a plurality of alternating transparent members 51, 52, 54 and 55 and liquid crystal members 56 and 57 with a set of different body position of the character and liquid crystal driving circuit selectively and repetitively driving each of the plurality of liquid crystal members to provide animated movement of the character's body. The visual display apparatus also has a controller 58 which is electrically coupled to the liquid crystal members 56 and 57 in order to repetitively turn them on and off. In the preferred embodiment the liquid crystal members 56 and 57 represent the mouth of Mickey Mouse in the open and closed position, respectively. U.S. Pat. No. 4,294,516 teaches a similar display apparatus which includes a stacked array of a plurality of alternating transparent and liquid crystal members and which creates the effect upon a viewer of a three-dimensional moving image.

In an alternative embodiment the visual display apparatus may include a dot matrix lighting display which provides a plurality of lighted and unlighted dots and a dot matrix driving circuit which selectively and repetitively lights and unlights each of the plurality of lighted and unlighted dots in order to form different body position of the character and to provide animated movement of the character's body. The dot matrix driving circuit includes a processing circuit which includes an electronicly programmable read only memory on which data controlling the shape and positions of the character's body is stored and which generates row input signals and column. The dot matrix driving circuit also includes a row selecting circuit which selects which rows of the dots are to be lighted of the dot matrix lighting display in response to the row input signals and a column selecting circuit which selects which columns of the dots are to be lighted of the dot matrix lighting display in response to the column input signals. U.S. Pat. No. 4,289,383 teaches an electro-optic display of the type operable to provide an image viewable either in the transmissive or reflective modes. The dot matrix driving circuit may also includes a microprocessor which has an electronicly programmable read only memory, on which data for controlling the shape and positions of the character's body is stored, and which generates different sets of row input signals and column input signals in response to the program stored on the electronicly programmable read only memory in order to form animated displays of different characters.

The visual display apparatus may also include an analog/quartz movement including a hour-hand and minute hand which also function as the character's arms.

From the foregoing it can be seen that an electronic audio-visual timepiece has been described. It should be noted that the sketches are not drawn to scale and that distances of and between the figures are not to be considered significant.

Accordingly it is intended that the foregoing disclosure and showing made in the drawing shall be considered only as an illustration of the principles of the present invention.

What is claimed is:

1. An electronic audio-visual timepiece which incorporates a synthetically produced voice of a character to audibly tell the time and an animated display of the character so that the character's body movements visually indicate the time and may be in sychronization with the character's voice, said electronic audio-visual timepiece comprising:

a. a housing having a face plate;

b. time updating means for producing updated time information and for generating an updated time output signal, said time updating means being disposed in said housing;

c. processing means for processing said updated time output signal and for generating an audio drive input signal and a visual drive input signal, said processing means being disposed in said housing;

d. speech generating means for generating the synthetically produced voice of the character in a predetermined speech pattern in order to audibly tell the time in response to said audio drive input signal, said speech generating means being disposed in said housing; and d. visually displaying means for visually displaying the character's body movements in order to visually indicate the time in response to said visual drive input signal, said visually displaying means being disposed in said housing, wherein the character's body movements may be in sychronization with the character's voice.

2. An electronic audio-visual timepiece according to claim 1 wherein said speech generating means comprises:

a. word selecting means for selecting words which will form a sentence telling time which the synthetically produced voice of the character's voice uses to audibly tell the time in response to said audio drive input signal;

b. a read only memory which is electrically coupled to said word selecting means and which generates a plurality of digital input signals which represent the sentence telling time;

c. an digital to analog converter which is electrically coupled to said read only memory and which converts said plurality of digital input signals to a plurality of analog input signals;

d. shape filtering means for shaping and filtering said plurality of analog input signals;

e. amplifying means for amplifying said plurality of shaped and filtered analog input signal; and f. a miniature speaker which is electrically coupled to said amplifying means.

3. An electronic audio-visual timepiece according to claim 1 wherein said visually displaying means comprises:

a. a stacked array of a plurality of alternating transparent and liquid crystal members with a set of different body position of the character; and b. liquid crystal driving means for selectively and repetitively driving each of said plurality of liquid crystal members to provide animated movement of the character's body.

4. An electronic audio-visual timepiece according to claim 1 wherein said visually displaying means comprises:

a. a dot matrix lighting means for providing a plurality of lighted and unlighted dots; and b. dot matrix driving means for selectively and repetitively lighting and unlighting each of said plurality of lighted and unlighted dots in order to form different body position of the character and to provide animated movement of the character's body.

5. An electronic audio-visual timepiece according to claim 4 wherein said dot matrix driving means comprises:

a. a processing means, including an electronicly programmable read only memory on which data controlling the shape and positions of the character's body is stored, for generating row input signals and column;

b. row selecting means for selecting which rows of said dots are to be lighted of said dot matrix lighting means in response to said row input signals; and c. column selecting means for selecting which columns of said dots are to be lighted of said dot matrix lighting means in response to said column input signals.

6. An electronic audio-visual timepiece according to claim 2 wherein said read only memory is electronicly programmable and said speech generating means also comprises processing means for generating the sentence telling time, said processing circuit being electrically coupled to said electronicly programmable memory, on which data providing the words and speech patterns of a character's voice is stored.

7. An electronic audio-visual timepiece according to claim 4 wherein said visually displaying means also comprises:

a. an analog/quartz movement including a hour-hand and minute-hand which also function as the character's arms.

* * * * *